US006421523B1

(12) United States Patent
Kondo et al.

(10) Patent No.: US 6,421,523 B1
(45) Date of Patent: Jul. 16, 2002

(54) IMAGE FORMING APPARATUS CAPABLE OF SHIFT STACKING DISCHARGED SHEET BUNDLE

(75) Inventors: Shunsaku Kondo, Numazu; Shokyo Koh, Mishima; Yoshihito Osari, Shizuoka-ken; Akinobu Nishikata, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/628,001

(22) Filed: Jul. 28, 2000

(30) Foreign Application Priority Data

Jul. 30, 1999 (JP) ..... 11-218178

(51) Int. Cl.[7] ..... G03G 15/00
(52) U.S. Cl. ..... 399/404; 270/58.3; 399/405
(58) Field of Search ..... 399/407, 404, 399/405, 403; 270/58.01, 58.3; 271/213

(56) References Cited

U.S. PATENT DOCUMENTS 4,201,464 A * 5/1980 Botte et al. ..... 399/403 X
4,568,172 A * 2/1986 Acquaviva ..... 399/403
4,684,241 A * 8/1987 Acquaviva
4,989,853 A * 2/1991 Matysek et al. ..... 270/58.3
5,007,625 A * 4/1991 Kremers et al. ..... 270/58.01
5,021,837 A 6/1991 Uto et al.
5,153,655 A 10/1992 Suzuki et al.
5,157,444 A 10/1992 Mori et al.

FOREIGN PATENT DOCUMENTS

JP 9-109488 * 4/1997

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus includes an image forming device for forming an image on a sheet, a tray for stacking a sheet on which the image is formed by the image forming device, a shifting device for shifting the sheet for each copy to stack the sheet on the tray, and a control device for controlling the shift operation of the shifting device at the time of the shift mode, wherein the control device controls the shifting device in such a manner that the shifting device does not shift the sheet when the number of the sheets per one copy is one while the shifting device shifts the sheets when the number of the sheets per one copy is two or more.

10 Claims, 16 Drawing Sheets

FIG. 10

275

| | | ORIGINAL PAGE NUMBER | | | | | | | | |
|---|---|---|---|---|---|---|---|---|---|---|
| | | 1 | 2 | 3 | 4 | 5 | 6 | 7 | 8 | 9 |
| SET MODE | 2 IN 1 | × | × | ○ | ○ | ○ | ○ | ○ | ○ | ○ |
| | 2 IN 1 (TWO-SIDED) | × | × | × | × | ○ | ○ | ○ | ○ | ○ |
| | 4 IN 1 | × | × | × | × | ○ | ○ | ○ | ○ | ○ |
| | 4 IN 1 (TWO-SIDED) | × | × | × | × | × | × | × | × | ○ |
| | SINGLE-SIDED→TWO-SIDED | × | × | ○ | ○ | ○ | ○ | ○ | ○ | ○ |
| | TWO-SIDED→TWO-SIDED | × | ○ | ○ | ○ | ○ | ○ | ○ | ○ | ○ |
| | TWO-SIDED→SINGLE-SIDED | ○ | ○ | ○ | ○ | ○ | ○ | ○ | ○ | ○ |
| | ENLARGED LAYOUT | ○ | ○ | ○ | ○ | ○ | ○ | ○ | ○ | ○ |
| | PAGE CONTINUOUS COPYING | ○ | ○ | ○ | ○ | ○ | ○ | ○ | ○ | ○ |

IMAGE FORMING APPARATUS CAPABLE OF SHIFT STACKING DISCHARGED SHEET BUNDLE

BACKGROUND OF THE INVENTION

1. Field of the Invention

The present invention relates to image forming apparatus, and more particularly to, for example, an image forming apparatus that is constituted to efficiently control the shift of sheets on which images are formed with the apparatus using the electrophotographic process.

2. Related Background Art

In recent years, image forming apparatus such as copying machines comprise image forming means for recording on a sheet such as paper an image read by a reader portion etc., and art of shift stacking the sheets by shifting one copy from another in the case where a sorting function is used on condition that the number of sheets per one copy is two or more, and the numeral (the number of copies) is two or more, has been developed.

With this art, a trouble of searching a boundary between copies can be omitted in the image forming process for a plurality of copies, which provides a greater convenience for users.

However, with the conventional image forming apparatus described above, when the sorting function is turned on, the shifting function is performed even on condition that there is no heed of shift stacking operation in which the number of sheets per one copy is one and the number of the numeral is two or more.

SUMMARY OF THE INVENTION

An object of the present invention is to provide an image forming apparatus capable of suspending a shifting function of sheets when the shifting function is not required in a shift stacking mode of the sorted sheets, which improves the convenience for users.

The image forming apparatus according to the present invention comprises:

an image forming device for forming an image on a sheet;

a tray for stacking the sheet on which the image is formed by the image forming device;

a shifting device for shifting the sheet for each copy to stack the sheet on the tray; and a control device for controlling a shift operation of the shifting device in a shift mode;

wherein the control device controls the shifting device in such a manner that the control device does not conduct the shift operation when the number of the sheets per one copy is one while the control device conducts the shift operation when the number of the sheets per one copy is two or more.

The image forming apparatus according to the present invention comprises:

an automatic original reading device for automatically feeding and reading the original;

an image forming device for forming an image on the basis of image information of the original;

a tray for stacking the sheet on which the image is formed by the image forming device;

a shifting device for shifting the sheets for each copy to stack the sheet on the tray; and a control device for controlling a shift operation of the shifting device in a shift mode;

wherein the a control device controls the shifting device in such a manner that the control device does not conduct the shift operation when the number of the sheets per one copy is one while the control device conduct the shift operation when the number of the sheets per one copy is two or more on the basis of the number of sheets on which the image is formed by the image forming device to be output depending on a number of pages of the original read by the automatic original reading device and an image formation mode.

The image forming apparatus according to the present invention comprises:

a data storage device for storing the image data;

an image forming device for forming an image on the basis of the image data in the data storage device;

an operating portion for setting each kind of mode for forming the image by the image forming device;

a tray for stacking the sheet on which the image is formed by the image forming device;

a shifting device for shifting the sheet for each copy to stack the sheet on the tray; and a control device for controlling a shift operation of the shifting device in a shift mode;

wherein the control device controls the shifting device in such a manner that the control device does not conduct the shift operation when the number of sheets per one copy is one while the control device conducts the shift operation when the number of sheets per one copy is two or more in accordance with the content stored in the data storage device and an image processing condition set by the operating portion.

It may be better that the control device controls the shifting device so that the operating portion does not receive the selection of the shifting device in accordance with the content stored in the data storage device and the image processing condition set by the operating portion when the number of sheets per one copy is one.

In a mode in which images on a plurality of originals are formed on one sheet even when the number of originals are two or more and the numeral is two or more, a number of sheets per one copy is one with the result that it would be better that the control device does not conduct the shift operation.

In a mode in which an image on one original is formed by dividing the image into two sheets when a number of the originals is one and the numeral is two or more, a number of the sheets per one copy is two, and it would be better that the control device conducts the shift operation.

An operator can arbitrarily set the shift mode.

It may be better that the shift mode is automatically set when the numeral is two or more.

The tray comprises a treatment tray and a stack tray. It may be better that the sheet is fed one by one to the treatment tray, and the sheet bundle is shifted on the treatment tray to be discharged to the stack tray.

It may be better that the sheet on the treatment tray is shifted in a direction intersecting the feeding direction by alignment means. On the other hand, it may be better that the stack tray is gradually lowered in accordance with the stack of the sheet bundle.

On the basis of the structure described above, the image forming apparatus has a function of shifting (sorting) the sheet on which images are formed by the image forming device. When the sheets are shift-stacked on the tray, the shifting of unnecessary sheets can be avoided by controlling the operation of shifting sheets as to whether the shifting is performed or not depending upon the number of sheets. For example, under a condition in which a number of sheets per one copy is one and a numeral is two or more, the invention makes it possible not to conduct a shift stacking operation so that a user's convenience is improved.

As has been described above, according to the present invention, the shift stacking of unnecessary sheets can be avoided with the result that the convenience for users can be improved.

BRIEF DESCRIPTION OF THE DRAWINGS

FIG. 10 is a view showing a combination example of the image formation mode and the number of sheets of the original at the time of shift stacking;

DESCRIPTION OF THE PREFERRED EMBODIMENTS

An image forming apparatus according to the present invention will be explained hereinbelow by giving a digital copying machine as one embodiment.

Figure 1:
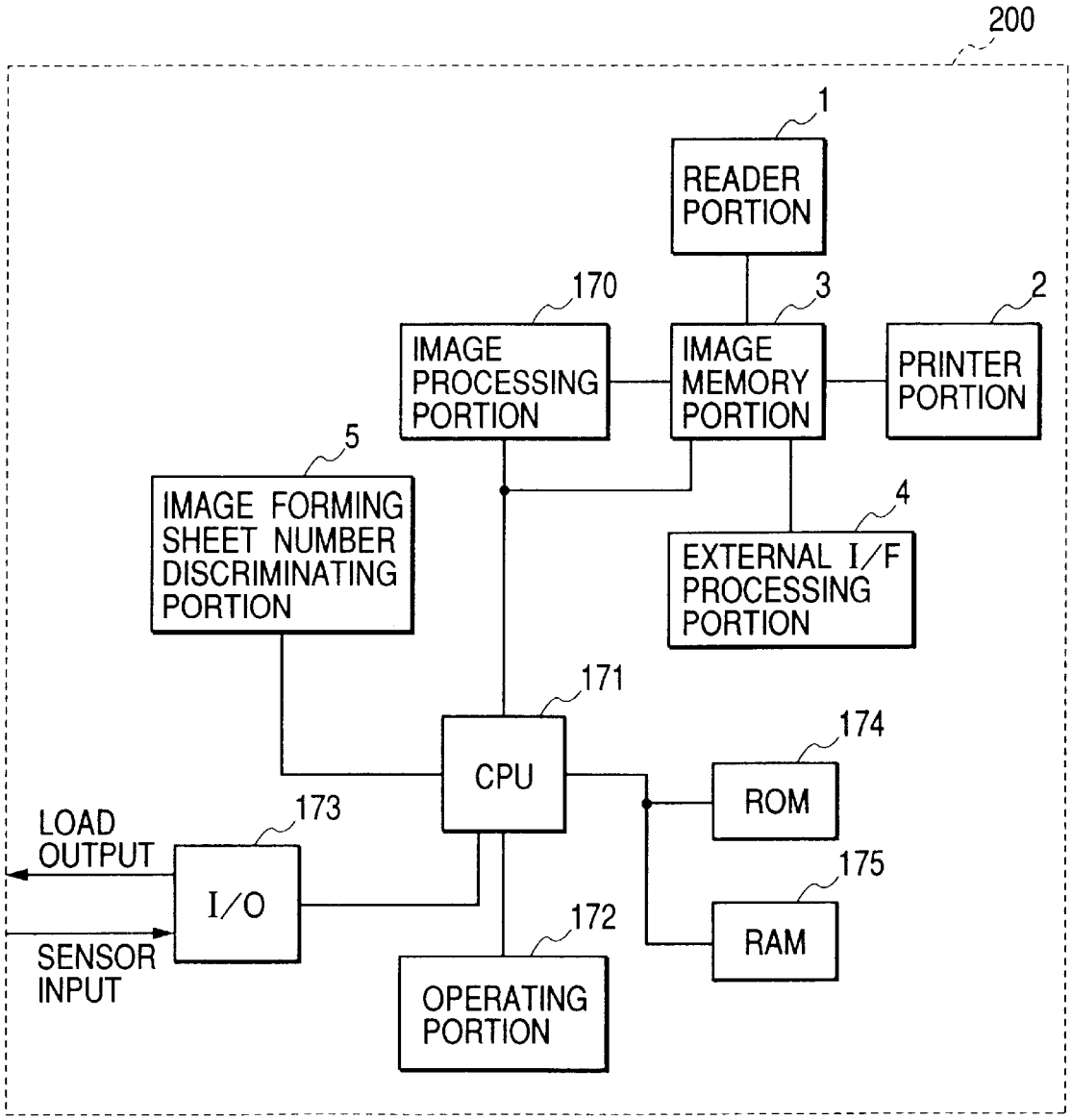
FIG. 1 is a block diagram showing a control in a digital copying machine as an image forming apparatus according to one embodiment of the present invention.

FIG. 1 is a block diagram showing a control within a digital copying machine 200. Reference numeral 171 denotes a CPU (a control device) for conducting a basic control of the digital copying machine 200, and a ROM 174 having a control program written therein, a work RAM 175 for conducting the processing, and an input/output port 173, are connected with an address bus and a data bus. To the input/output port 173, each kind of load (not shown) such as a motor and a clutch, and an input (not shown) of sensor or the like for detecting the position of a sheet of paper are connected.

The CPU 171 subsequently controls the input and the output via the input/output port 173 in accordance with the content of the ROM 174 with the result that an image forming operation is conducted. On the other hand, an operating portion 172 is connected with the CPU 171 to control the display means of the operating portion 172 and the key input means. The operator instructs the change over of the display of the image forming operation mode, the scanner reading mode, and the print output mode to the CPU 171. The CPU 171 displays the state of the digital copying machine 200 and the setting of the operation mode by the key input. To the CPU 171, an image processing portion 170 for processing a signal which has been converted into an electric signal with the image sensor portion 208, and an image memory portion 3 for storing the processed image are connected. Reference numeral 5 denotes a portion for judging the number of the sheets on which the image is formed, the portion judging the number of sheets per one copy output at the time of image formation from the mode set with the operating portion 172 or the like and the processing result in the image processing portion 170.

Figure 2:
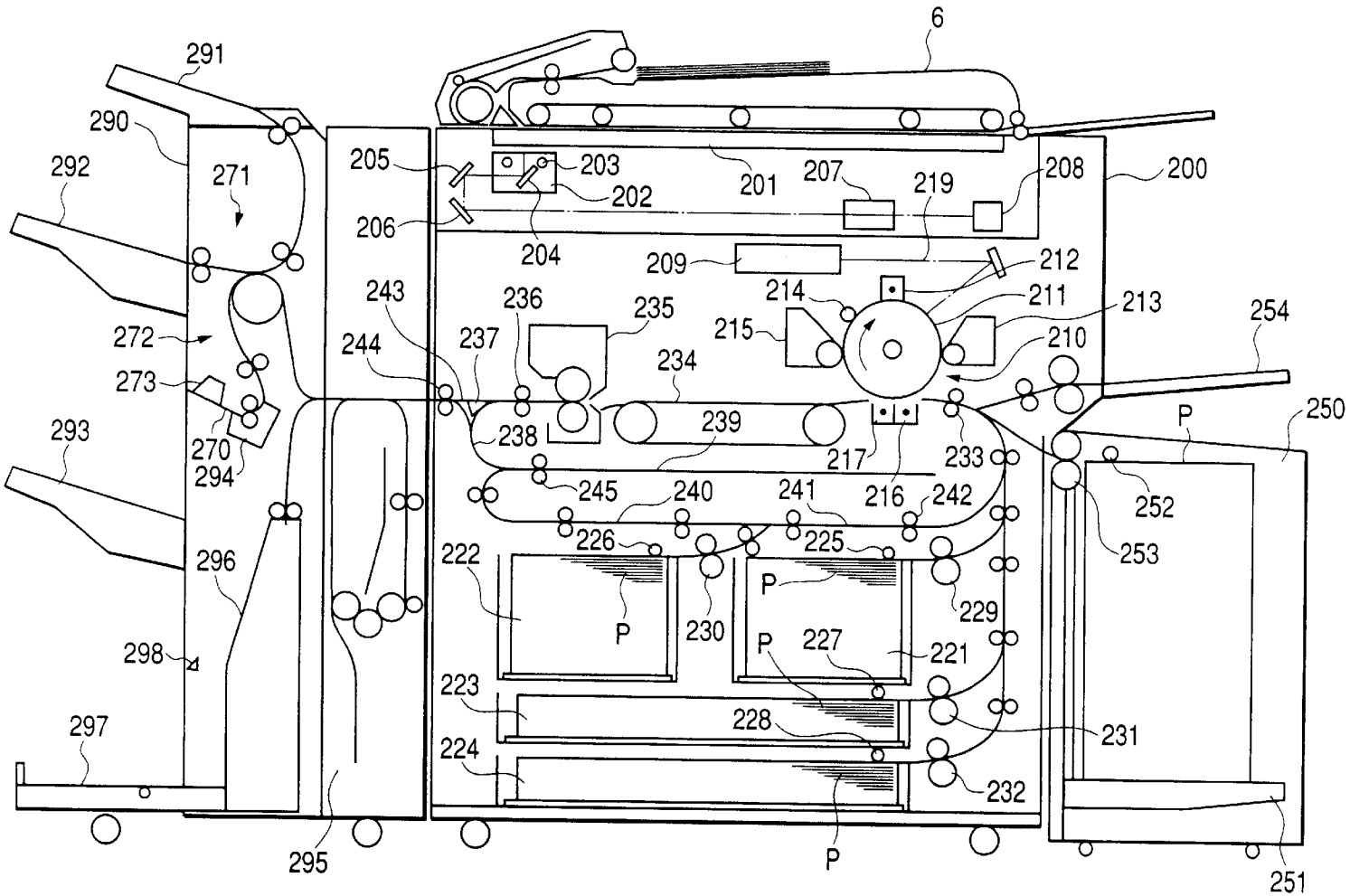
FIG. 2 is a vertical cross-sectional front view showing the digital copying machine.

FIG. 2 is a sectional structure view showing the digital copying machine according to the present invention.

In FIG. 2, reference numeral 200 denotes the main body of the digital copying machine and reference numeral 6 denotes an automatic original feeding (reading) device (DF). Reference numeral 201 denotes a platen glass plate which serves as an original stocking plate, and reference numeral 202 denotes a scanner comprising an original illumination lamp 203, a scanning mirror 204 and the like.

With the motor not shown, the scanner 202 scans back and forth the original in a predetermined direction, and reflection light of the original is allowed to pass through a lens 207 via scanning mirrors 204 through 206 with the result that an image is formed on a CCD sensor within the image sensor portion 208. Reference numeral 209 denotes an exposure controlling portion which is comprised of a laser, a polygon scanner etc. In the exposure controlling portion 209, laser beams 219 are irradiated on a photosensitive drum 211, the laser beams 219 being converted into an electric signal with the image sensor portion 208, and being modulated on the basis of an image signal which has been subjected to a predetermined image processing described below.

On the periphery of the photosensitive drum 211, a primary charger 212, a developing device 213, a transfer charger 216, a pre-exposure lamp 214 and a cleaning device 215 are provided. In the image forming portion (image forming means) 210, the photosensitive drum 211 is rotated in a direction of an arrow by a motor not shown. After the photosensitive drum 211 is charged to a predetermined potential with the primary charger 212, the laser beams 219 from the exposure controlling portion 209 are irradiated with the result that an electrostatic latent image is formed. The electrostatic latent image formed on the photosensitive drum 211 is developed by the developing device 213 to be visualized as a toner image.

On the other hand, the sheet picked up from a right cassette deck 221, a left cassette deck 222, an upper-step cassette 223 or a lower-step cassette 224 by pickup rollers 225, 226, 227 and 228 are sent to the main body by feed rollers 229, 230, 231 and 232, and are fed to a transfer belt by a registration roller 233 with the result that the toner image that has been visualized is transferred to the sheet with the transfer charger 216. In the photosensitive drum 211 after the transfer, a residual toner is cleaned by a cleaning device 215, and a residual charge is eliminated by the pre-exposure lamp 214. The sheet after the transfer is separated from the photosensitive drum 211 by the separation charger 217 and is sent to the fixing device 235 by the transfer belt 234. With the fixing device 235, the image is fixed with heating and pressure, and the sheet is discharged out of the main body 200 by the discharge roller 236. The main body 200 is equipped with, for example, a deck 250 which can accommodate 4000 sheets. A lifter 251 of the deck 250 rises in accordance with the amount of sheets in such a manner that the sheets are allowed to abut against the feed roller 252 at all times. The sheets are sent to the main body by the feed roller 253. Furthermore, a multiple manual feed tray 254 is equipped which can accommodate 100 sheets.

Furthermore, in FIG. 2, reference numeral 237 denotes a discharge flapper for changing over a path on the side of a conveyance path 238 with a path on a discharge path 243. Reference numeral 240 denotes a lower conveyance path for guiding the sheet sent out from the discharge roller 236 to a re-feed path 241 via a surface reverse path 239 by reversing the front side and the back side of the sheet. The sheet fed from the left cassette deck 222 by the feed roller 230 is also sent to the re-feed path 241. Reference numeral 242 denotes a re-feed roller for re-feeding the sheet to the image forming portion 210. Reference numeral 244 denotes a discharge roller arranged in the vicinity of the discharge flapper 237 for discharging the sheet which is changed over to the side of the discharge path 243 with this discharge flapper 237 to the outside of the copying machine.

At the time of the two-sided recording (two-sided copying), the discharge flapper 237 is raised upward and the copied sheet is sent to the re-feed path 241 via the conveyance path 238, the surface reverse path 239 and the lower conveyance path 240. At this time, the trailing end of the sheet is completely discharged out of the conveyance path 238 by the surface reverse roller 245. At the same time, the sheets are pulled into the surface reverse path 239 to the position in the state in which the sheet is nipped into the surface reverse roller 245 to be sent out to the conveyance path 240 by reversely rotating the surface reverse roller 245. When the sheet is reversed and discharged from the main body, the discharge flapper 237 is raised upward and the trailing end of the sheet is pulled into the surface reverse path 239 to the position in the state in which the trailing end of the sheet is allowed to remain in the conveyance path 238 with the surface reverse roller 245. By reversely rotating the surface reverse roller 245, the sheet is reversed to be sent to the side of the discharge roller (discharge means) 244.

Reference numeral 290 denotes a sheet treatment device which serves as a discharge treatment device for jogging sheet discharged from the image forming apparatus 200 to stitch the sheet wherein the sheet discharged one after another is stacked one by one by the treatment tray (sorting means) 270 to jog the width direction of the sheets with a pair of aligning plates (shift means) 273. When the discharge of one copy of the image formation is ended, the sheet bundle is discharged to the discharge tray 293 (or 292). By repeating the above operation, a plurality of bundles is stacked on the tray 293. When the sheet bundle is discharged, the sheets can be shift-stacked by shifting one copy from another with an offset of the aligning plates 273 in the width direction of the sheets.

The discharge tray 293 is moved and controlled up and down with the motor not shown to be moved, so that the discharge tray 293 is located at the treatment tray 270 before the initiation of the image forming operation. When the sheets discharged after that are stacked, the sheets are moved in such a manner that the height of the paper surface becomes equal to the position of the treatment tray 270. Furthermore, reference numeral 298 denotes tray lower limit sensor for detecting the lower limit of the discharge tray 293. The tray lower limit sensor 298 functions to detect the stacking of about 2000 sheets on the discharge tray 293. Reference numeral 291 denotes the paper tray for stacking the tab sheet which is inserted between sheets discharged. Reference numeral 295 denotes a Z-folding machine for folding the discharged sheet in a Z-folded manner. Furthermore, reference numeral 296 denotes a bookbinding machine for binding a book by folding one copy of the discharged sheets at the center in unison, and fixing the sheets with a stapler, and the sheet bundle formed into one book is discharged to the discharge tray 297.

Figure 3:
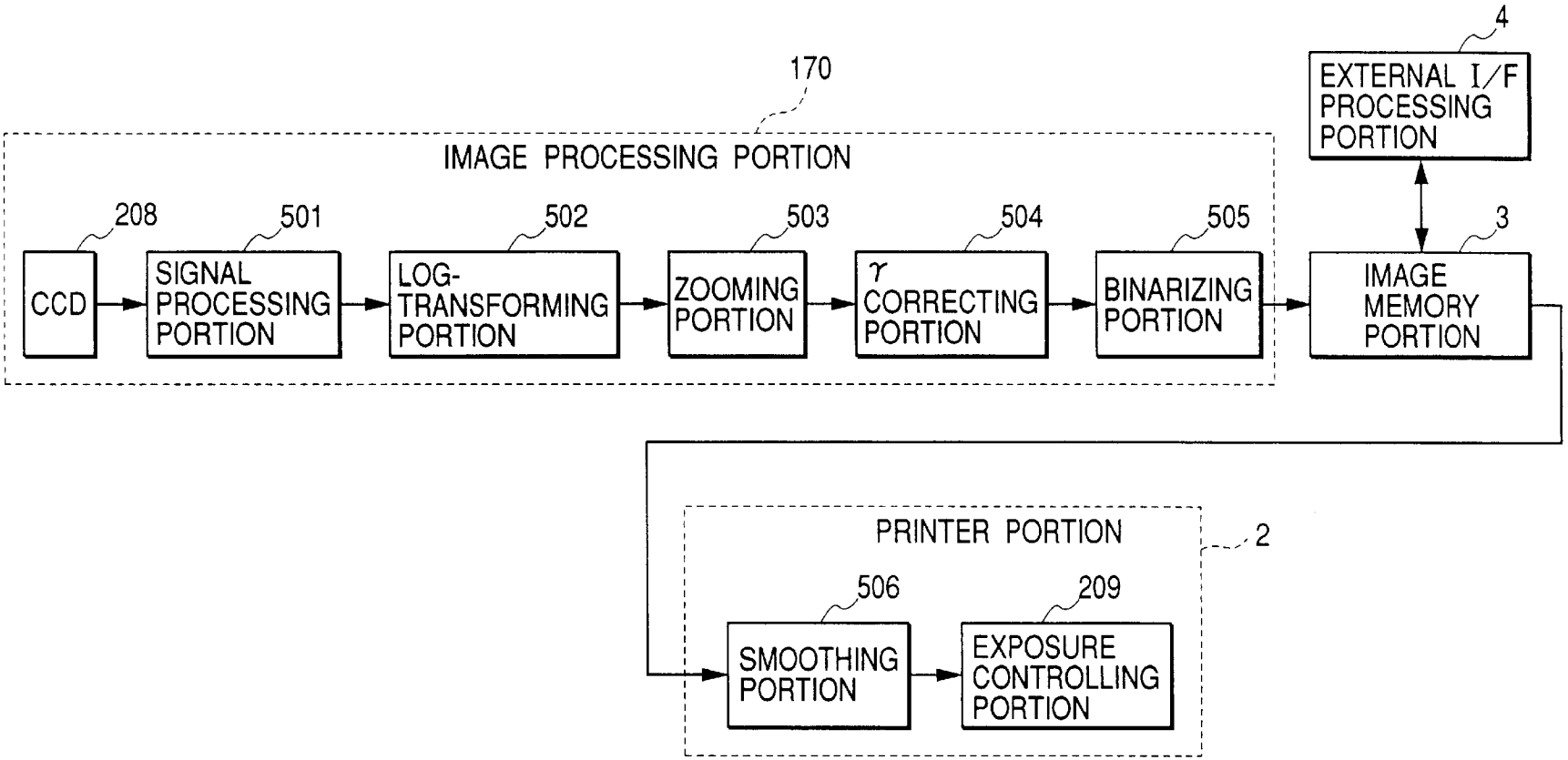
FIG. 3 is a block diagram showing an image processing portion.

Next, the image forming portion 170 will be described in detail with reference to FIG. 3. FIG. 3 is a block diagram of the image forming portion.

The original image formed on the CCD sensor via the lens 207 is input as data of black luminance and is converted into an analog electric signal with the CCD sensor. The converted image information is input into the analog signal processing portion (not shown). Then, sampling and holding, dark level correction or the like is performed, followed by the analog/digital conversion (A/D conversion) at an A/D conversion portion 501, and then, the digitalized signal is subjected to a shading correction (correction of a disparity in the sensor for reading the original and of the light distribution property of the lamp for original illumination). Thereafter, the signal is sent to the loc-transforming portion 502.

In the log-transforming portion 502, an LUT is stored for transforming the input luminance data into density data, so that the luminance data is transformed into the density data by outputting the table value corresponding to the input data. Thereafter, the magnification of the image is converted to a predetermined magnification with the zoom processing portion 503 to be input to the γ-correction portion 504. At the time of outputting the density data at the γ-correction portion 504, the conversion by the LUT in consideration of the properties of the printer is made with the result that the adjustment of the output corresponding to the density value set at the operating portion is performed. Thereafter, the data is sent to the binarizing portion 505. At the binarizing portion 505, multiple value density data is converted into a binary value with the result that the density value becomes either "0" or "255". An 8-bit long image data is converted into a binary value to be converted into 1-bit long image data of "0" or "1" with the result that the image data quantity stored in the memory becomes small.

However, when the image is converted into a binary value, the number of graduations of the image becomes 2 levels from 256 levels. Therefore, the deterioration of the image generally becomes conspicuous when the image data such as photo images having many halftones is converted into binary values. Then, it is required to provide a pseudo-halftone expression by the binary value. Here, an error dispersion method is used as a technique for providing halftone expression in a pseudo manner with the binary value. In this method, when the density of a certain image is larger than a certain threshold value, the data of 255-density is provided. When the data is a certain threshold value or less, the data of 0-density is provided. As a result, after the data is converted into the binary value, a difference between the actual density data and the binary value data is distributed to the surrounding pixels as an error signal. The difference is distributed by multiplying the weighting coefficient on the matrix which is prepared in advance by an error generated by the conversion of the density into the binary value, and by adding the product to the surrounding pixels. As a consequence, the average value of the density on the whole image is conserved and the halftone can be expressed in the binary value in a pseudo manner. The image data converted into the binary value is sent to the image memory portion 3, so that the image is stored.

Furthermore, since the image data from the computer which is input from the external I/F processing portion 4 is processed as binary value image data at the external I/F processing portion, the image data is sent to the image memory portion 3 as it is. The image memory portion 3 has a high-speed page memory and a large capacity memory (a hard disk) which can store the image data in a plurality of pages. A plurality of image data items stored in the hard disk is output in an order corresponding to the edition mode designated at the operating portion of the digital copying machine 200. For example, in the case of sorting, the images in the original bundle read from a DF 6 are output in order. The stored image data of the original is read out from the hard disk, and this operation is repeated, and thereby outputting the image. As a consequence, a bin can serve as a plurality of sorters.

The image data output from the image memory portion 3 is sent to a smoothing portion 506 located at the printer portion 2. At the smoothing portion 506, the data is interpolated so that the end portion of the image converted into the binary value becomes smooth. The image data is output to the exposure controlling portion 209. At the exposure controlling portion 209, the image data is formed onto a sheet by the above processing.

Figure 4:
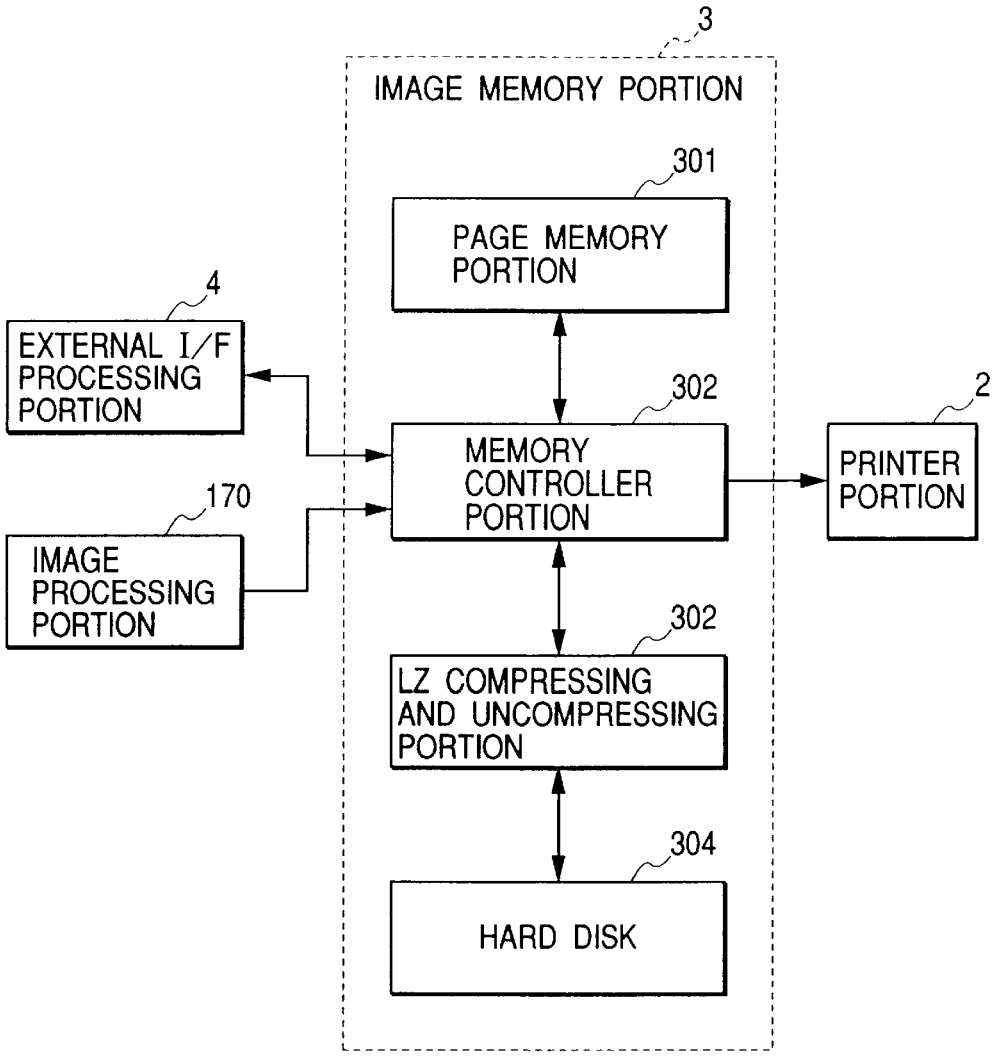
FIG. 4 is a detailed view showing an image memory portion.

Next, the image memory portion 3 will be explained in detail with reference to FIG. 4.

At the image memory portion 3, the binary value image is written on the page memory portion 301 comprising memories such as DRAM from the external I/F processing portion 4 and the image processing portion 170 while read out to the external I/F processing portion 4 and the printer portion 2 via the memory controller portion 302. Then, the input and output of the image into the hard disk 304, which is a large capacity memory device, is accessed. At the memory controller portion 302, a DRAM refresh signal of the page memory portion 301 is generated, and the access to the page memory portion 301 from the external I/F processing portion 4, the image processing portion 170, and the hard disk 304 is arbitrated.

Furthermore, in accordance with the instruction of the CPU 171, writing address to the page memory portion 301, reading address from the page memory portion 301, the reading direction or the like are controlled. Thus, the CPU 171 lays out a plurality of original images by arranging the originals on the page memory portion 301 thereby controlling the function of outputting the original image to the printer portion, a function of cutting out a part of the image and outputting the image, and the function of rotating the image.

Figure 5:
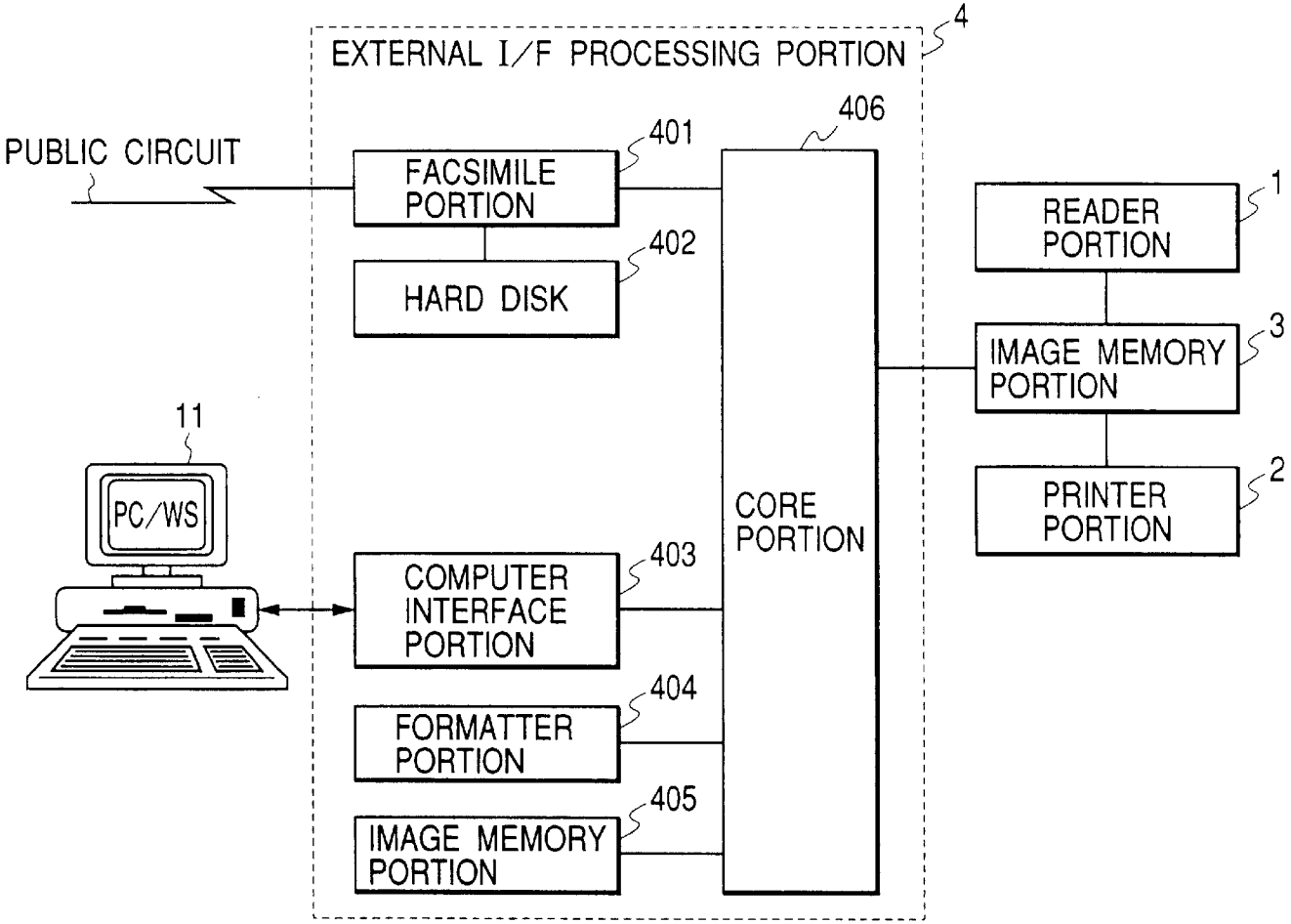
FIG. 5 is a structure view showing an external I/F processing portion 4.

Next, the structure of the external I/F processing portion 4 will be described with reference to FIG. 5.

As described above, the external I/F processing portion 4 incorporates a binary value image data of a reader portion into the external I/F processing portion via the image memory portion 3, and serves to form an image by outputting the binary value image data from the external I/F to the printer portion 2 via the image memory portion 3. The external I/F processing portion 4 has a core portion 406, a facsimile portion 401, a hard disk 402 for saving a communication image data in the facsimile portion, a computer interface portion 403 connected with the external computer 11, a formatter portion 404, and an image memory portion 405.

The facsimile portion 401 is connected to a public circuit via a modem (not shown) to conduct the reception of facsimile communication data from the public circuit and transmission of the facsimile communication data to the public circuit. At the facsimile portion 401, the facsimile image is saved in the hard disk 402 and processed in such that facsimile transmitting operation is conducted at a designated time and the image data is transferred in response to an inquiry of the discharged password from the other side as a function of the facsimile machine. By doing so, after the images are transmitted to the facsimile portion 401 and a hard disk 402 for the facsimile machine via the reader portion 1 through the image memory portion 3, the facsimile transmitting operation can be conducted without using the image memory portion 3 for the facsimile function.

The computer interface portion 403 is an interface portion for conducting data communication with the external computer, the computer interface portion having the local area network (hereinafter referred to as LAN), a serial I/F, an SCSII/F, a centronics I/F for data input of the printer and the like. Via this I/F, the state of the printer portion and the reader portion 1 is notified of to the external computer, and the image read at the reader portion under the instruction of the computer is transmitted to the external computer. Besides, the printed image data is received from the external computer. Since the printed data notified of through the computer interface portion 403 from the external computer is described in dedicated printer code, the formatter portion 404 converts the code into a raster image data for forming an image at the printer portion 2 via the image memory portion 3.

The formatter portion 404 develops the raster image data at the image memory portion 405. In this manner, the image memory portion is used as a memory which allows the formatter portion 404 to develop the raster image data. Furthermore, the image memory portion is also used in the case where the image in the reader portion is transmitted to the external computer via the computer interface portion 403 (an image scanner function), when the image data transferred from the image memory portion 3 is developed in the image memory portion once and is converted into a data format to be transferred to the external computer.

The core portion 406 controls and manages the data transfer between the facsimile portion 401, the computer interface portion 403, the formatter portion 404, the image memory portion 405, and the image memory portion 3. Thus, even when the external I/F processing portion 4 is provided with a plurality of image output portion, and even when there is only one image transfer channel to the image memory portion 3, the image is output by exclusive control and priority control under the management of the core portion 406.

Next, the operation of the automatic original feeding device (DF) of the present invention will be explained with reference to FIG. 6A and FIGS. 6B through 6M showing a rough sectional view showing the automatic original feeding device 6.

Figure 6A:
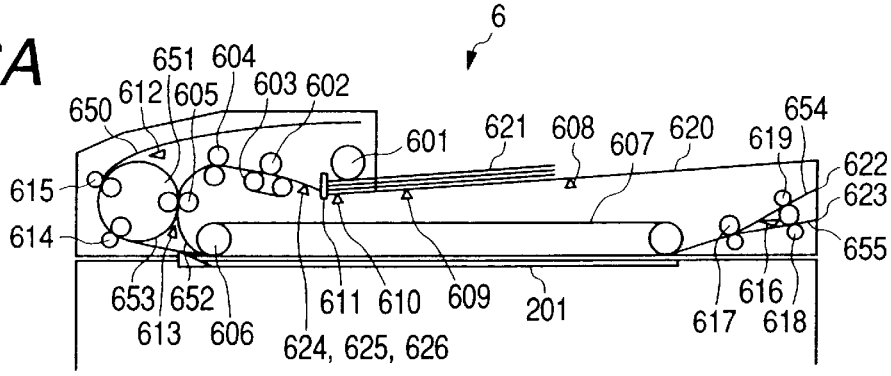
FIG. 6A is a vertical cross-sectional front view of an automatic original feeding device.

In the beginning, each part of the DF 6 will be explained with reference to FIG. 6A. Reference numeral 601 denotes a pickup roller for picking up the original on the uppermost sheet of the original stack 621 by allowing the pickup roller 601 to fall onto the sheet surface of the, original stack 621 stacked on the original tray 620 for stacking the original stack comprising at least one or more sheets and by rotating the pickup roller 601. Reference numeral 611 denotes a stopper projecting in a manner as shown in FIG. 6A prior to the initiation of the feeding of the original. The original stack 621 is restricted with this stopper 611, so that the original stack 621 is not allowed to proceed in a downstream direction. The original fed by the pickup roller 601 is separated into one sheet with an action between the separation roller 602 and the separation belt 603. The separation is realized with the known retard separation art. Reference numeral 604 denotes a conveyance roller to convey the original separated with the separation roller 602 and the separation belt 603 to the registration roller 605. The registration roller 605 is allowed to come into contact with the original to form a loop thereby correcting the skew feeding in the conveyance of the original.

In a lower direction of the registration roller 605, a surface reverse feed flapper 613 is arranged for guiding the original which has passed through the registration roller 605 to the feed path 652 or the surface reverse inlet path 653 which serves as the conveyance path to the direction of the platen 201. Reference numeral 614 denotes a first surface reverse roller. Reference numeral 615 denotes a second surface reverse roller which is rotated in the case where the original is reversed together. Reference numeral 612 denotes a surface reverse flapper for guiding the original which comes from the direction of the second surface reverse roller 615 to the surface reverse path 650 or the re-feed path 651. Reference numeral 606 denotes a belt drive roller for driving the feed belt 607 for arranging the original on the platen. The feed belt 607 abuts against the platen 201. Reference numeral 617 denotes a feed and discharge roller for feeding and discharging the sheet of the original fed from the manual feed port 622, and the original fed by of the feed belt 607 is discharged to the original discharge port 623. Reference numeral 616 denotes a discharge flapper for guiding the original to the manual feed and discharge path 654 or the original discharge path 655. The discharge,flapper 616 functions so that the original is not discharged toward the manual feed port 622 at the time of the discharge of the original. Reference numeral 619 denotes a manual feed and discharge roller to manually feed and discharge the original. Reference numeral 618 denotes a discharge roller for discharging the original.

Furthermore, at the lower portion of the original tray 620, three sensors (608 through 610) are arranged. Reference numeral 610 denotes a detection sensor for detecting the setting of the original, the sensor being a transmitting type light sensor for detecting the fact that the original stack 621 has been set. Reference numeral 608 denotes an original trailing end detection sensor serving as a reflection-type light sensor for judging whether or not the original is a half-size original. The sensor 609 arranged between the detection sensor 610 for detecting the setting of the original and the original trailing end detection sensor 608 is a final original detection sensor which is the reflection-type light sensor for judging whether or not the original being conveyed is the final original.

Furthermore, reference numerals 624, 625, and 626 denote the original size detection sensor for detecting the size of the original being conveyed. Three sensors are arranged in the width direction thereof. The width of the original is detected in three stages from three sensor values to judge the width of the original of type A and type B, or A4 and A5. Furthermore, the length of the original is also detected from the passage time of the original. By doing so, even with respect to the original stack having mixed different originals in size, the size of individual original can be detected. However, at this time, the original stack is such that the side of the width direction of the original is Jogged to be stacked.

Next, there will be explained an operation of the automatic original feeding device 6 at the time of reading both sides of the original (two-sided original) having printed on both sides thereof.

Figure 6B:
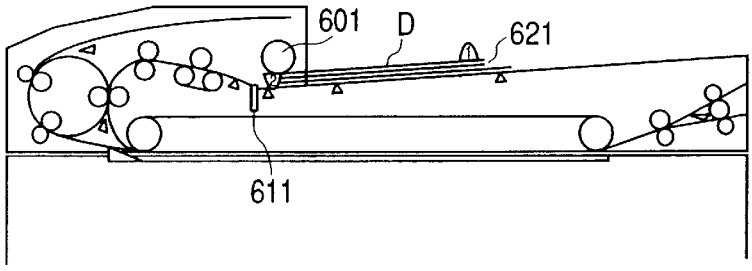
FIGS. 6B, 6C, 6D, 6E, 6F, 6G, 6H, 6I, 6J, 6K, 6L and 6M are views showing an operation of the automatic original feeding device.

When an instruction is given to initiate the feeding of the two-sided original to the automatic original feeding device 6, the stopper 611 is lowered and the pickup roller 601 is further allowed to fall on the upper surface of the original (FIG. 6B).

Figure 6C:
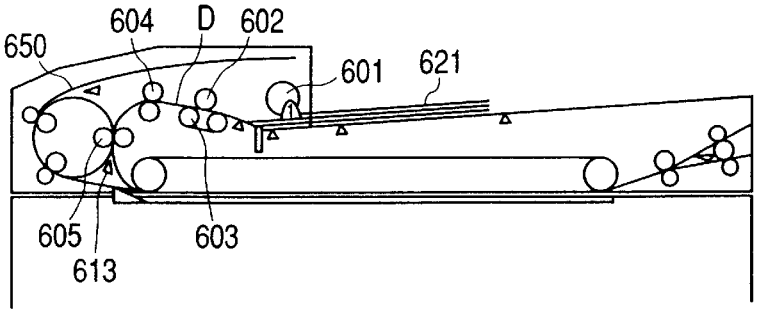

With the operation of the pickup roller 601, the separation roller 602, the separation belt 603 and the conveyance roller 604, only one sheet of the original D is separated from the uppermost surface of the original stack 621 to be conveyed to the registration roller 605 (FIG. 6C). At this time, the surface reverse feed flapper 613 is set in a direction of conveying the original to the surface reverse path 650.

Figure 6D:
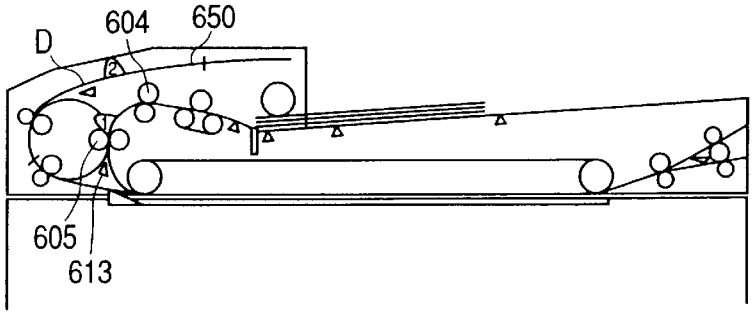
Figure 6E:
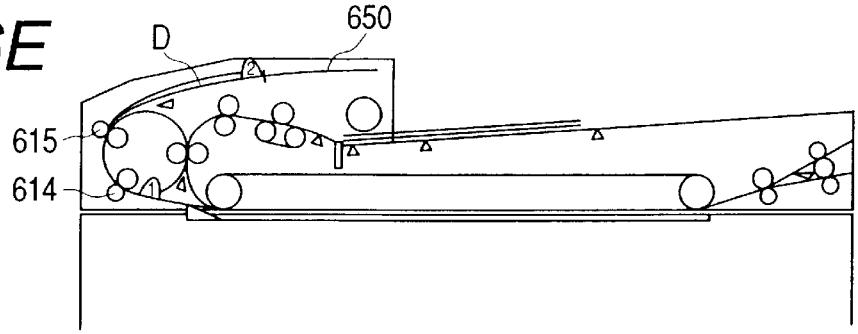
Figure 6F:
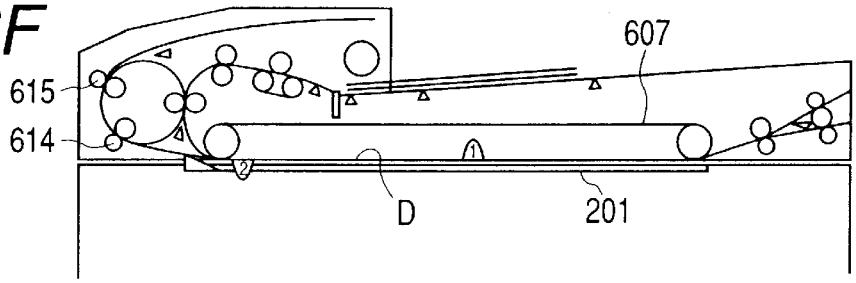

When the registration roller 605 is rotated, the original D is conveyed to the position shown in FIG. 6E via a path shown in FIG. 6D. From here, the drive directions of the first surface reverse roller 614 and the second surface reverse roller 615 are reversed, and the original D is sent onto the platen 201 to be suspended at a position of FIG. 6F.

Figure 6G:
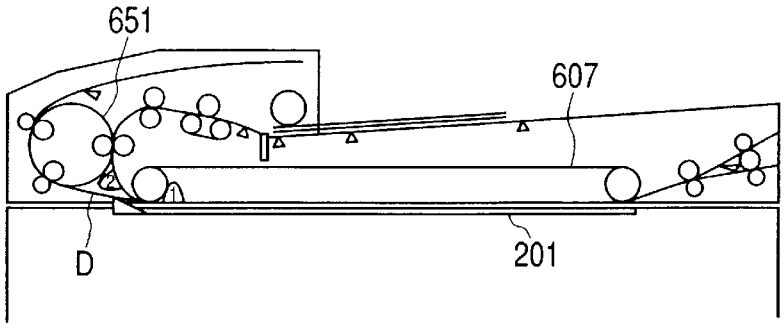
Figure 6H:
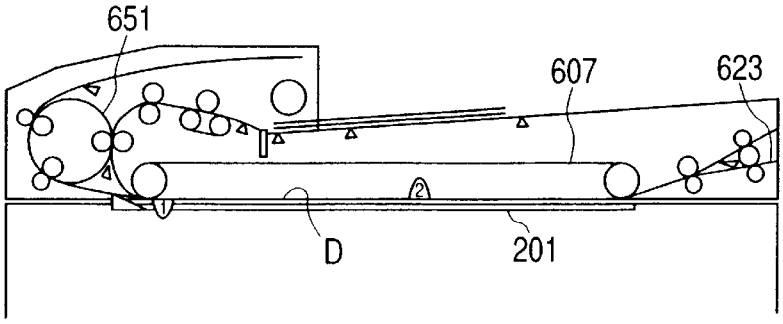

When the reading of the original is ended, the original is reversed via the re-feed path 651 as shown in FIG. 6G to be fed onto the platen 201 again as shown in FIG. 6H.

When the reading of the original D is ended, the original is sent to the right direction and is discharged to the outside of the automatic original feeding device 6 from the original discharge port 623. By the repetition of the above operation, the two-sided original is separated one by one from the uppermost surface to read the two sides of the original, and the original can be discharged with the upper surface faced downward (face down).

Next, there will be explained the operation of original reading method (flow-reading) for reading the original by fixing the scanner 202 at a predetermined position and moving the original with the two cases; the case in which the original is a small size and the case in which the original include a large size. In this embodiment, the small size refers to a size which the original trailing end detection sensor 608 cannot detect while the large size refers to a size which the original trailing end sensor 608 detects when the original stack 621 is stacked on the original tray 620.

Figure 6I:
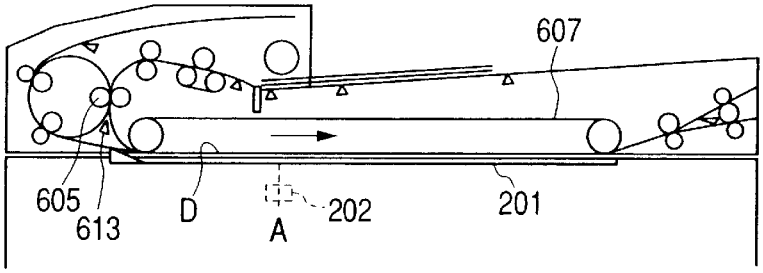
Figure 6J:
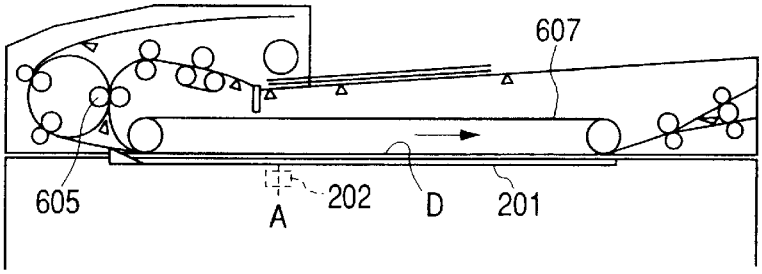
Figure 6K:
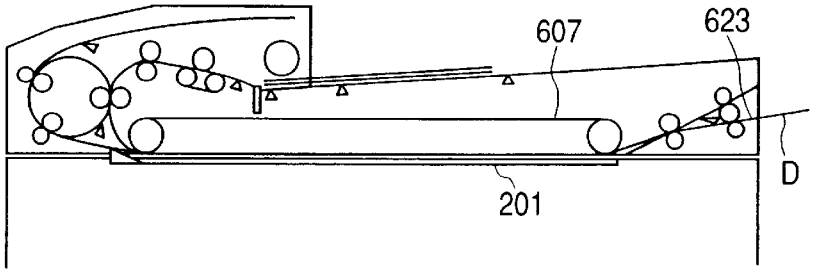

In the beginning, the flow-reading of only the original having the small size will be explained. The operation until the original reaches the registration roller 605 is explained with reference to FIG. 6A through FIG. 6C. In the case of the flow-reading, as shown in FIG. 6I, the surface reverse feed flapper 613 guides the original D onto the platen 201. The original D is conveyed at a predetermined speed on a point A as shown in FIG. 6I, and the image of the original D is read by a scanner 202 waiting at the lower portion of the point A (FIG. 6J). The point A is defined as a position where the trailing end of the small size original has passed the registration roller 605. The original is conveyed to the right direction as it is in FIG. 6J and is discharged to the outside of the automatic original feeding device 6 from the discharge port 623 of the original (FIG. 6K).

Figure 6L:
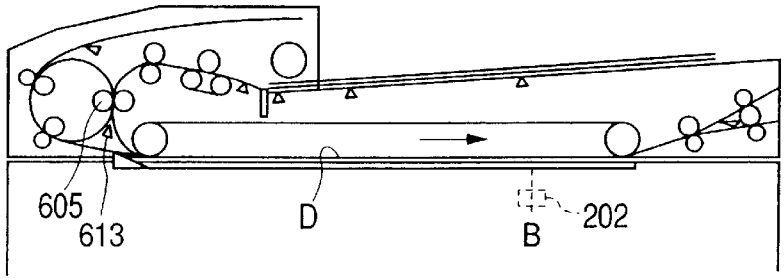
Figure 6M:
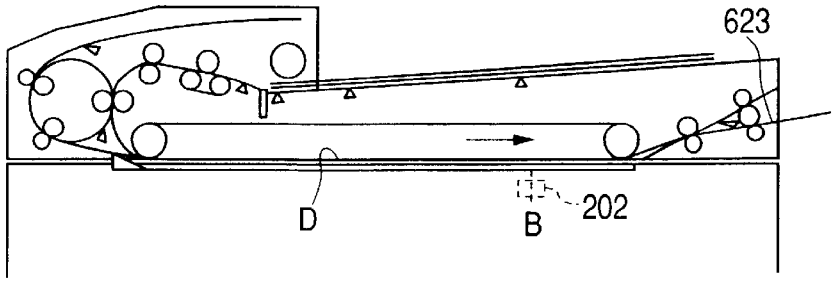

Next, the flow-reading of the original including the large size will be explained. The operation until the original D reaches the registration roller 605 is explained with reference to FIG. 6A through FIG. 6C. In the case of the flow-reading, as shown in FIG. 6L, the surface reverse feed flapper 613 guides the original onto the platen 201. The original is conveyed at the predetermined speed on a point B as shown in FIG. 6L, and the image of the original is read by the scanner 202 waiting at the lower portion of the point B. The point B is defined as a position where the trailing end of the large size original has passed the registration roller 605. The original is conveyed to the right direction as it is in FIG. 6L and is discharged to the outside of the automatic original feeding device 6 from the discharge port 623 of the original (FIG. 6M).

Finally, in the case of the original fixed reading for reading the image by moving the scanner 202, the original D is stacked at a position (shown in FIG. 6H) where the trailing end of the original D is aligned with the end portion of the platen 201.

Figure 7:
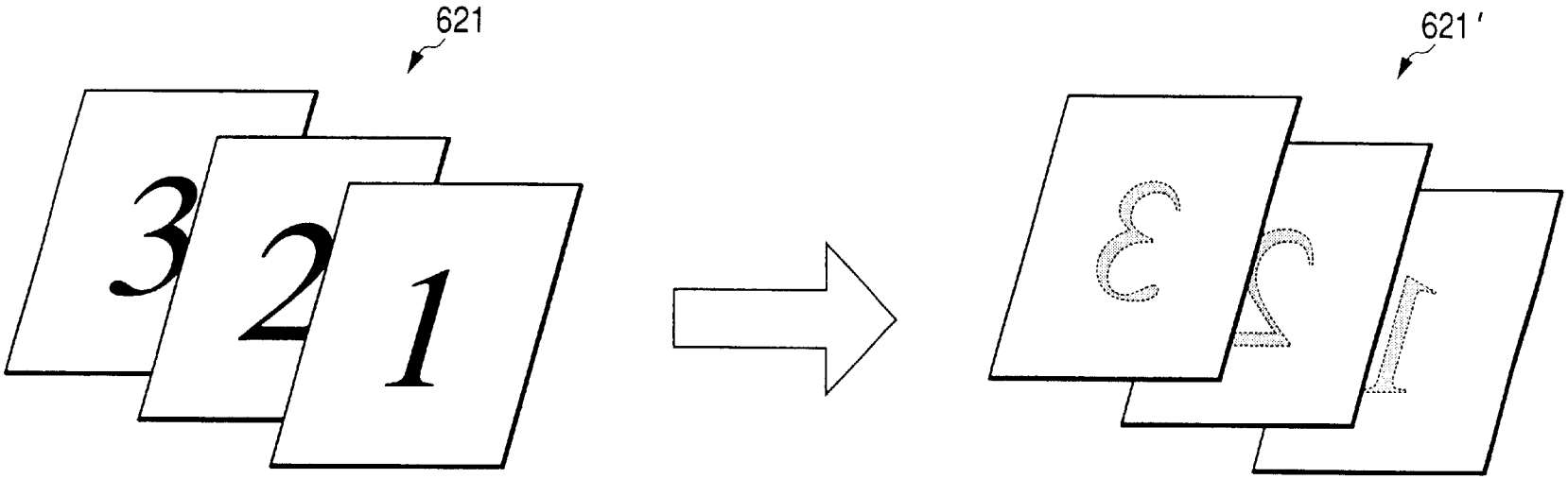
FIG. 7 is a view showing a direction of an original bundle discharged from an original discharge port.

Next, FIG. 7 shows how the direction of the original stack 621 set on the original tray 620 on the automatic original feeding device 6 corresponds to the direction of the original stack 621' conveyed and discharged to the discharge port 623 of the original D. The original shown on the left side of the FIG. 7 is the original stack 621 set on the original tray 620. The original stack is conveyed in order from the original numbered 1 located on the uppermost surface of the original stack and is output with the surface reversed up side down with the result that the original on the uppermost surface of the original stack is turned up side down to be discharged as the lowermost surface of the original stack as shown on the right of FIG. 7.

Next, the function of the personal box will be explained with reference to FIG. 8.

Reference numeral 810 denotes a hard disk which comprises a temporary area 800 and a personal box area 801.

The temporary area 800 is an area which temporarily stores the image data and eliminates the image data after the job is completed. The personal box area 801 stores the PDL image received from a host 820 in an area (a personal box) corresponding to the personal box number designated by the host 820 per image data developed at the external I/F processing portion. The user is able to print the above image data stored in the personal box corresponding to the number of his own personal box. Furthermore, the personal box area 801 also stores a print mode at the printing time attendant on the above image data and the automatic elimination time which has been set.

For example, in the case of a hard disk having a 1 GB-long capacity, 300 MB-long capacity is allocated to the temporary area 800 while 700 MB is allocated to the personal box area 801. As shown in FIG. 8, when the number of the personal boxes is 10, the box area which can be possessed by each individual attains to 70 MB respectively. Besides, each personal box has its own number, and for instance, the numbers of the boxes 802, 803, 804 and 805 are box numbers 0, 1, 2 and 9, respectively.

Figure 8:
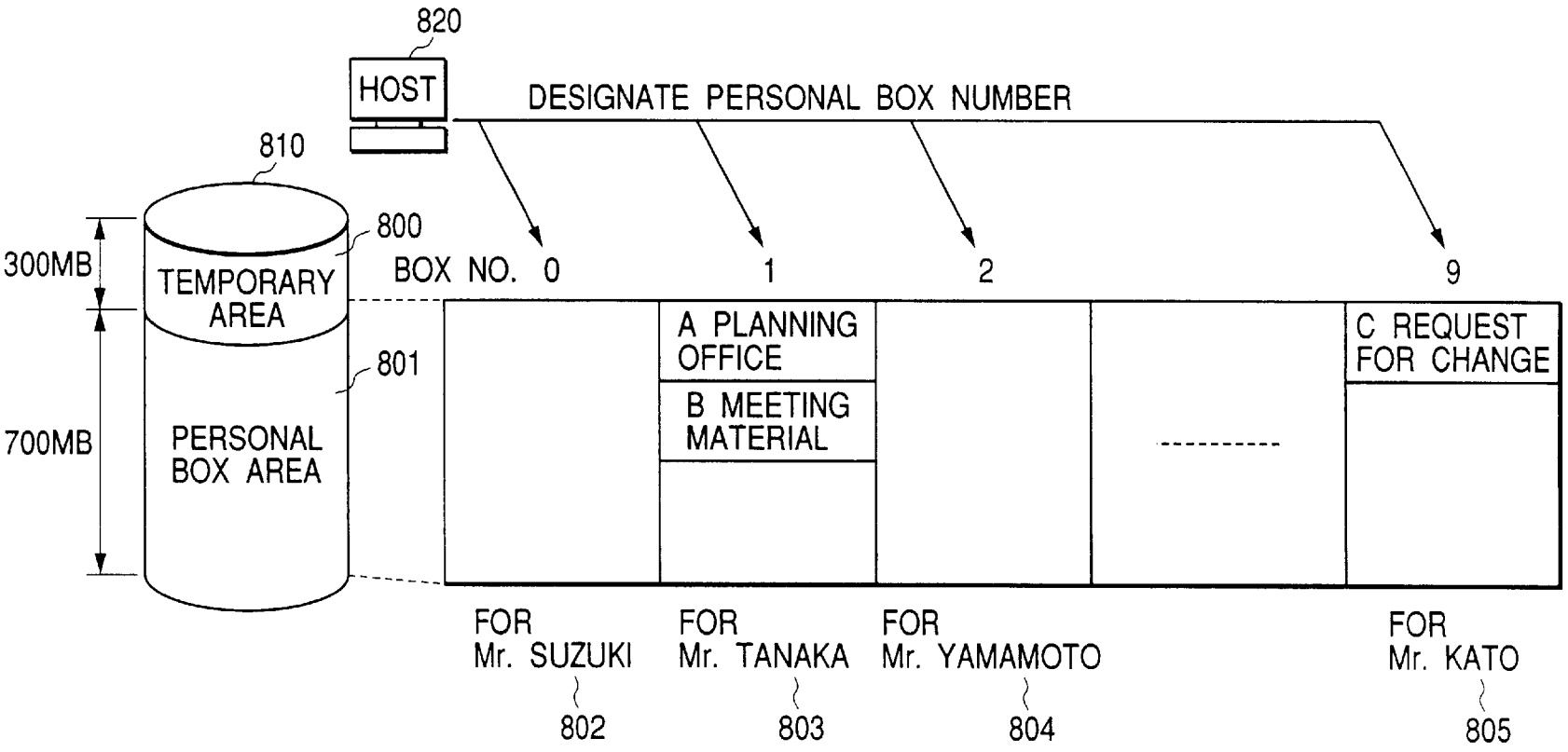
FIG. 8 is a developed view showing image data stored in a personal box.

In the example shown in FIG. 8, the number of Mr. Tanaka's box is 1. When a user named Mr. Tanaka wants to enter PDL document in his own box from the host 820, the box number 1 is designated with the host 820. Besides, in the case where the user named Mr. Tanaka wants to enter his own PDL document in other's box, for example, the user named Mr. Tanaka wants to enter the PDL document into a box of a user named Mr. Kato from the host 820, the box number of the receiver to whom the message is sent, namely, in this case 9 is designated with the host 820.

Through such a procedure, it becomes possible to mail his own PDL document to other's box.

<Explanation of Shift Stacking>

Figure 9A:
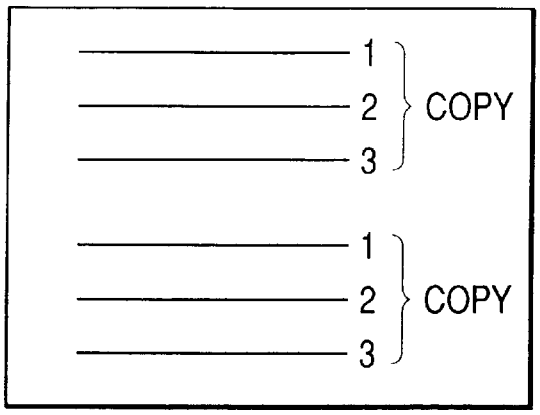
FIG. 9A is a view showing a definition of a "copy"

Here, the function of shift stacking will be explained. Here, a "copy" will be explained. FIG. 9A shows a state in which the number of sheets output from the image forming device is three, and the sheet with the numeral 2 is output. One line represents one sheet. As shown in FIG. 9A, a set of output sheets will be hereinafter referred to as the "copy".

Figure 9B:
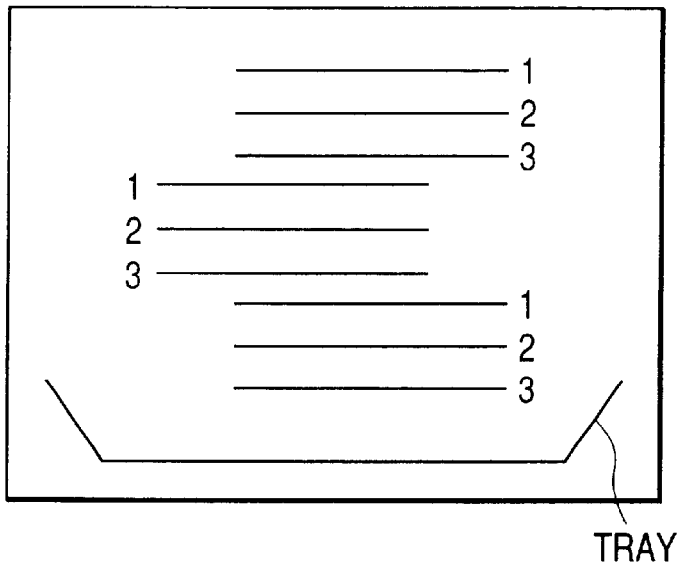
FIG. 9B is a view showing a shift stacking state.
Figure 9C:
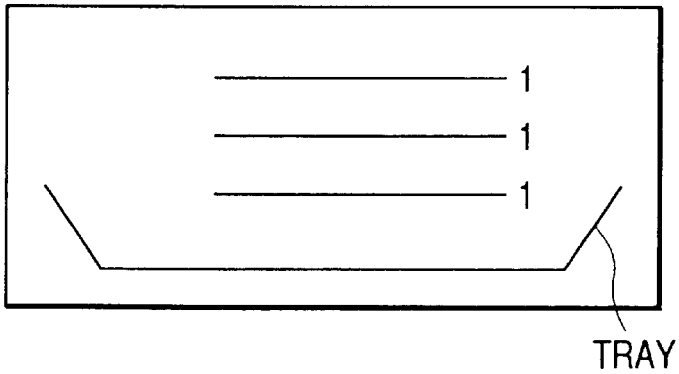
FIG. 9C is a view showing a state in which the original is not shift stacked.

The shift stacking refers to, in the digital copying machine in this embodiment, a function of shift stacking sheets discharged one copy after another by the image forming device 200 on the treatment tray 270 for each boundary of one copy when the sorting function described above is operated. FIG. 9B shows the shift stacking in the case where the number of sheets per one copy is three and the numeral is three, and the copy is shifted for each boundary of the copy. Since the sheets are set for each copy to be shift stacked on the tray, the trouble of searching the boundary of the copies can be omitted when the user sorts the sheets for each copy. Furthermore, as an example, in the case where the number of sheets for each copy is one, and the numeral is three, the sheets are stacked on the tray without conducting shift stacking as shown in FIG. 9C. This is because since the number of sheets per one copy is one, there is no need to sort the sheets for each copy.

The condition of conducting the shift stacking the sheets is that the sorting function is effective, the numeral is two or more, and the condition is determined by the combination of set image formation mode and the number of paces of the original.

As a result of this combination, the shift stacking becomes effective in the case where the number of sheets per one copy is two or more. A part of the combination example based on this judgment is shown in a table (means for calculating the output number of sheets) of FIG. 10. Symbol ○ denotes a case in which the number of sheets per one copy is two or more, namely, the shift stacking of the sheets is conducted. Symbol × denotes a case in which the number of sheets per one copy is one, namely the shift stacking of the sheets is not conducted.

Figure 11:
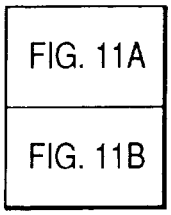
FIG. 11 which is composed of FIGS. 11A and 11B is a flowchart showing a control operation (at the time of using the automatic original reading device) according to one embodiment of the present invention.
Figure 11A:
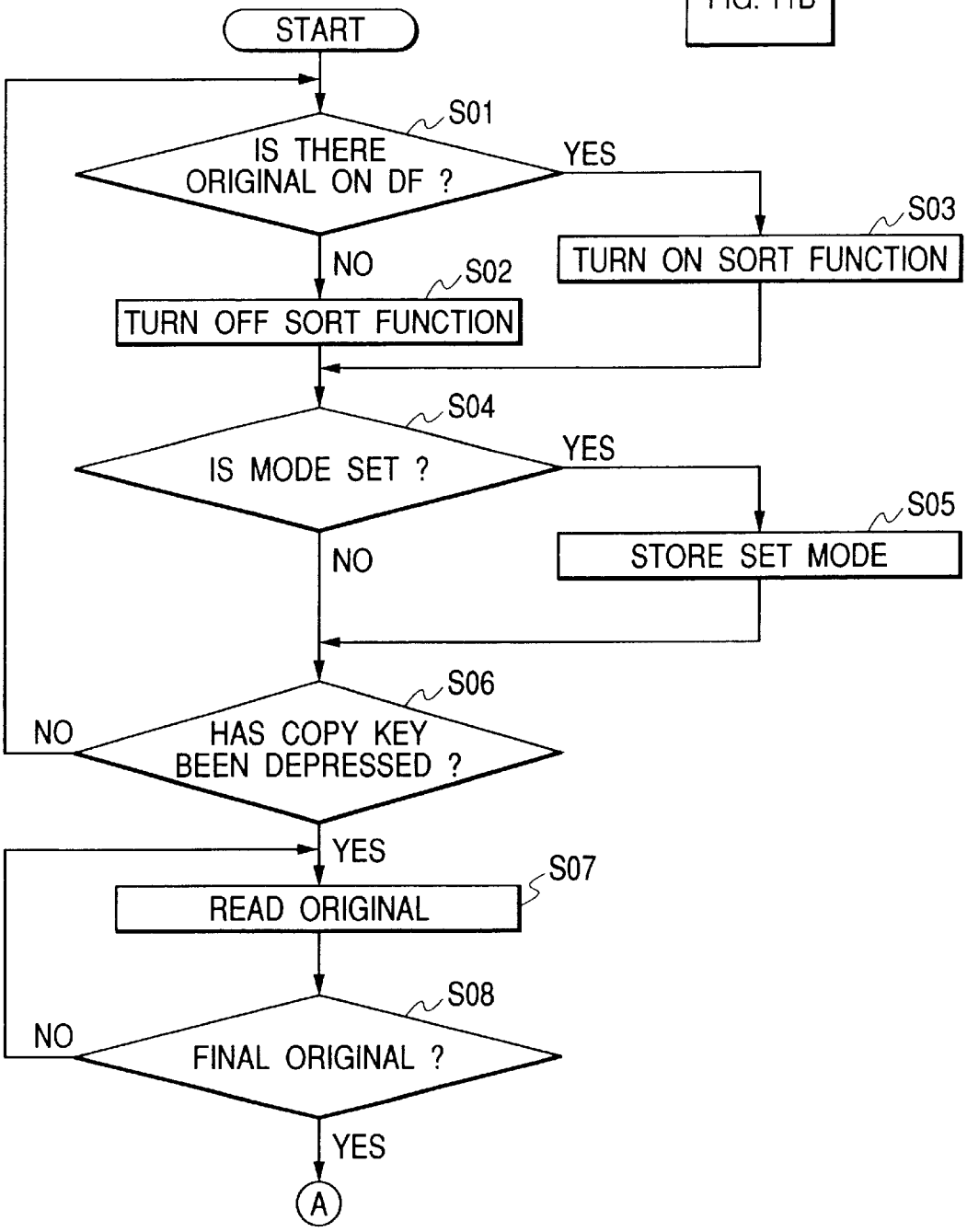
Figure 11B:
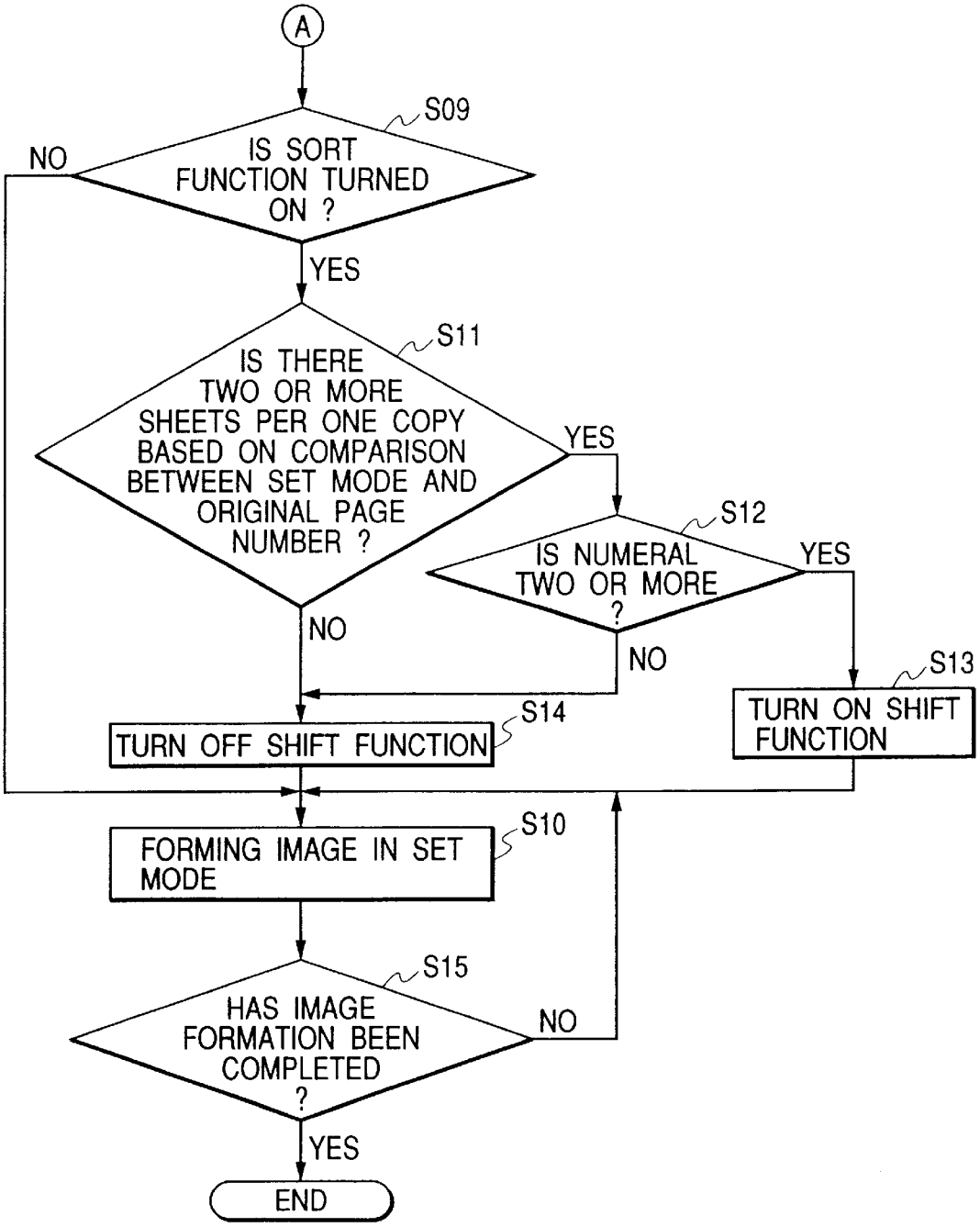

An operation of the form in the embodiment will be explained with reference to the flowchart of FIGS. 11A, 11B and 12.

In the beginning, a control operation will be explained in the case where the image is read by using the automatic original feeding device (DF) 6 with reference to a flow chart of FIGS. 11A and 11B. The condition is that when the original is stacked on the DF 6, the setting is made so that the sorting function is automatically turned on, and the sorting function is turned off in the initial state.

In the beginning, a judgment is made as to whether or not the original is placed on the DF6 (step S01). In the case where the original is placed on the DF, the sorting function is turned off (step S02). On the other hand, when the original is placed on the DF, the sorting function is turned on (step S03). Next, a judgment is made as to whether or not the mode has been set (step S04).

At step S04, the mode such as the image forming condition, the numeral or the like is set. When the mode is set, the content is stored in the work RAM 175 (step S05). When the mode is not set, the process proceeds to step S06. At step S06, a judgment is made as to whether or not a copy keypad has been depressed or not. When the copy keypad is depressed, the DF is operated, and the original is read (step S07). At step S06, when the copy keypad is not depressed, the process returns to step S01. Subsequent to step S07, a judgment is made as to whether or not the original is read up to the final original (step S08). In the case where the original is not read up to the final original, the process returns to step S07 with the result that the reading of the original is continued.

In the case where the original is read up to the final original, a judgment is made as to whether or not the sorting function is turned on (step S09). In the case where the sorting function is not turned on, the image is formed in the mode that has been set (step S10). In the case where the sorting function is turned on, a judgment is made as to whether or not number of sheets per one copy becomes two or more by comparing the set mode memorized at step S05 with the number of the pages of the original (step S11). The judgment on the number of sheets is performed in accordance with, for example, table 275 of FIG. 10.

In the case where the number of sheets per one copy becomes two or more, the judgment of the numeral is subsequently made (step S12). In the case where the numeral is two or more, the shift function is turned on (step S13). When the numeral is not two or more, namely one, the shift function is turned off (step S14). In the case where the number of sheets per one copy is not two or more, namely one, the shift function is turned off (step S14).

Next, the image is formed in the set mode (step S10). Next, a judgment is made as to whether or not the image formation is completed (step S15). When the image formation is not completed, the image formation is continued. When the image formation is completed, the program is ended.

In the present embodiment, as a condition, when the original is stacked on the digital copying machine DF6 of FIG. 1, it is set that the sorting function is automatically turned on. However, it may be constituted in such a manner that the setting of the sorting function may be arbitrarily set by the user.

Figure 12:
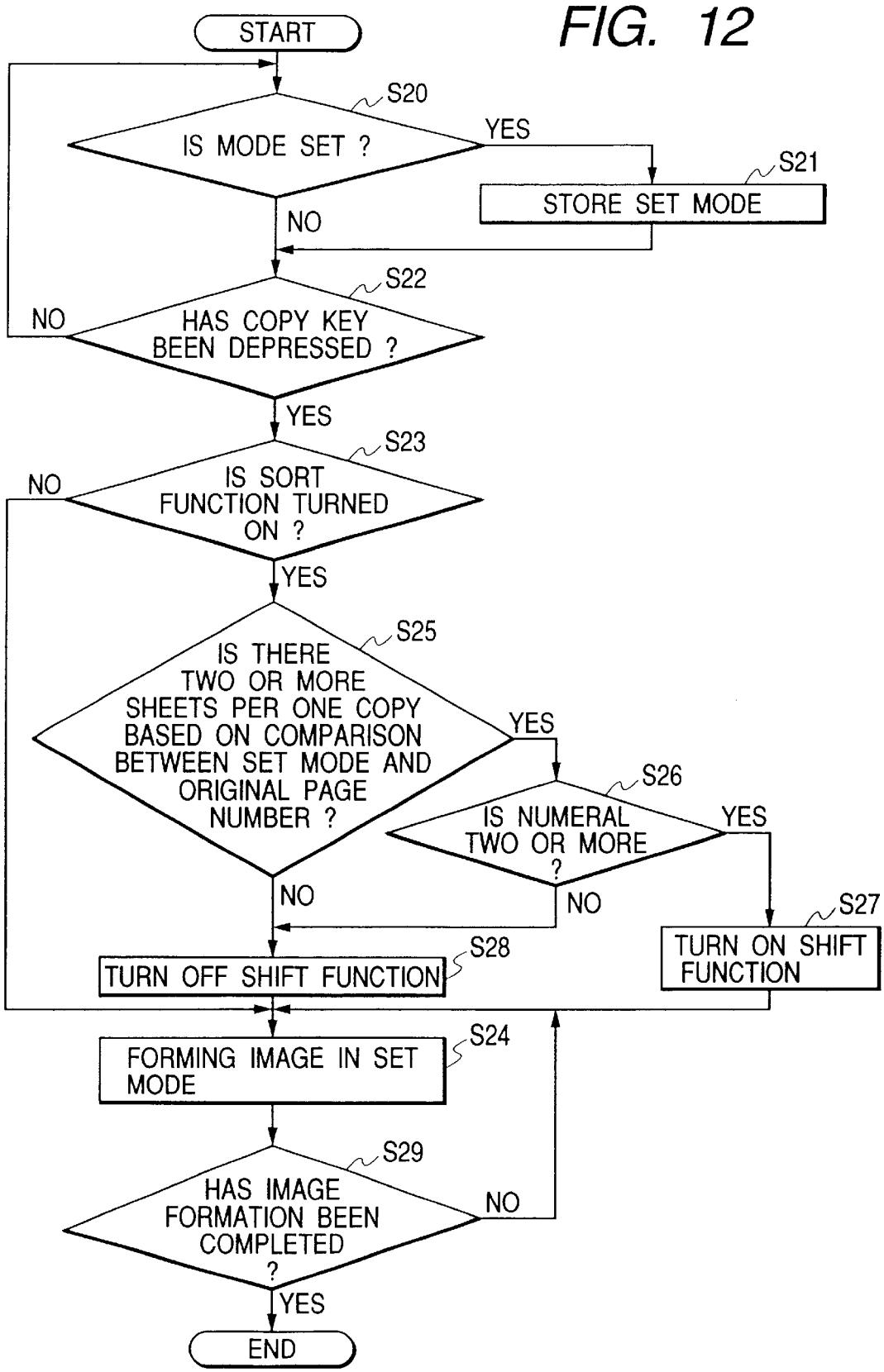
FIG. 12 is a flowchart showing a control operation (at the time of forming an image of image information stored in the personal box) according to one embodiment of the present invention.

Next, with reference to a flowchart of FIG. 12, there is shown a case in which the image information stored in the personal box is used to form an image. In the personal box, the image information is stored. In such a case, the digital copying machine 200 is capable of grasping the number of pages of the original.

In the beginning, a judgment is made as to whether or not the mode is set with the operating portion 172 (step S20). At step S20, the mode such as the image formation condition, the numeral, the sorting function or the like can be set. In the case where the mode is set, the content is stored in the work RAM 175 (step S21). In the case where the mode is not set, the process proceeds to step S22. At step S22, a judgment is made as to whether or not the copy keypad is depressed. When the copy keypad is depressed, the process proceeds to step S23. When the copy keypad is not depressed, the process returns to step S20. At step S23, the content of the work RAM is referred to, and a judgment is made as to whether or not the sorting function is turned on.

In the case where the sorting function is turned on, the process proceeds to step S25. In the case where the sorting function is not turned on, the process proceeds to step S24, and the image is formed in the mode that has been set. At step S25, the set mode stored in the work RAM 175 is compared with the number of pages of the original so that a judgment is made as to whether the number of the sheets per one copy becomes two or more.

In the case where the number of sheets per one copy becomes two or more, the process proceeds to step S26. At step S26, a judgment is made as to whether the numeral is two or more. When the numeral is two or more, the shifting function is turned on (step S27). In the case where the numeral is not two or more, namely one, the shifting function is turned off (step S28).

At step S25, when the number of sheets per one copy is not two or more, namely one, the shifting function is turned off (step S28). Next, the process proceeds to step S24, and an image is formed in the set mode. Finally, a judgment is made as to whether or not the image formation is completed. When the image formation is not completed, the image is formed until the image formation is completed. When the image formation is completed, the program is ended.

In an example of FIG. 12, the control is constituted in such a manner that the shift stacking function is automatically set. For example, at the time of the setting of the image formation condition at the operating portion 172, the control is constituted in such a manner that the setting of the shift stacking is not received with the combination of the mode setting.

What is claimed is:

1. An image forming apparatus comprising:

image forming means for forming an image on a sheet;

a tray for stacking a sheet on which the image is formed by said image forming means;

shifting means for shifting sheets for each copy to stack the sheets on the tray; and control means for controlling a shift operation of the shifting means in a shift mode, wherein said control means controls said shifting means in such a manner that said shifting means does not shift sheets when a number of sheets per one copy is one while said shifting means shifts sheets when the number of sheets per one copy is two or more.

2. An image forming apparatus comprising:

an automatic original reading device for automatically feeding and reading an original;

image forming means for forming an image on the basis of image information of the original;

a tray for stacking the sheet on which the image is formed by said image forming means;

shifting means for shifting sheets for each copy to stack the sheets on the tray; and control means for controlling a shift operation of said shifting means in a shift mode, wherein said control means controls said shifting means in such a manner that said shifting means does not shift sheets when a number of sheets per one copy is one while said shifting means shifts sheets when the number of sheets per one copy is two or more on the basis of the number of sheets on which the image is formed by said image forming means to be output depending upon a number of pages of the original read by said automatic original reading device and an image formation mode.

3. An image forming apparatus comprising:

data storage means for storing an image data image forming means for forming an image on the basis of the image data in said data storage means;

an operating portion for setting each kind of mode for forming the image by said image forming means;

a tray for stacking the sheet on which the image is formed by said image forming means;

shifting means for shifting sheets for each copy to stack the sheets on the tray; and control means for controlling a shift operation of said shifting means in a shift mode, wherein said control means controls said shifting means in such a manner that said shifting means does not shift sheets when a number of the sheets per one copy is one while said shifting means shifts sheets when the number of the sheets per one copy is two or more depending upon a content stored in said data storage means and an image processing condition set by said operating portion.

4. An image forming apparatus according to claim 3, wherein said control means controls said shifting means in such a manner that said shifting means does not shift sheets by refusing a receipt of a selection of said shifting means by said operating portion when the number of the sheets per one copy is one depending upon the content stored in said data storage means and the image processing condition set by said operating portion.

5. An image forming apparatus according to claim 2, wherein even if the number of the original is two or more and even if a numeral is two or more, the number of sheets per one copy is one in a mode that images on a plurality of originals are formed on one sheet, therefore, the sheet is not shifted.

6. An image forming apparatus according to claim 2, wherein even if the number of the original is one and even if a numeral is two or more, the number of sheets per one copy is two in a mode that one original image is divided and formed on two sheets, therefore, the sheet is shifted.

7. An image forming apparatus according to any of claims 1, 2 or 3, wherein the shift mode can be arbitrarily set by an operator.

8. An image forming apparatus according to claim 2, wherein the shift mode is automatically set when a numeral is two or more.

9. An image forming apparatus according to any of claims 1, 2 or 3, wherein said tray has a treatment tray and a stack tray, the sheet is discharged to said treatment tray one by one, and a sheet bundle is shifted on said treatment tray to be discharged onto said stack tray.

10. An image forming apparatus according to claim 9, wherein the sheet on said treatment tray is shifted in a direction intersecting a discharge direction by aligning means, and said stack tray gradually lowers in accordance with a stack of the sheet bundle.

* * * * *

UNITED STATES PATENT AND TRADEMARK OFFICE

CERTIFICATE OF CORRECTION

PATENT NO. : 6,421,523 B1
DATED : July 16, 2002
INVENTOR(S) : Shunsaku Kondo et al.

It is certified that error appears in the above-identified patent and that said Letters Patent is hereby corrected as shown below:

Column 1,
Line 29, “heed” should read -- need --.

Column 2,
Line 1, “the a” should read -- the --.
Line 5, “conduct” should read -- conducts --.

Column 6,
‘ Line 29, “loc-“ should read -- log- --.

Column 9,
Line 1, “the,” should read -- the --.
Line 39, “discharge,flapper” should read -- discharge flapper --.

Column 10,
Line 5, “Jogged” should read -- jogged --.
Line 45, “include” should read -- includes --.

Column 12,
Line 30, “paces” should read -- pages --.

Signed and Sealed this

Fourth Day of February, 2003

JAMES E. ROGAN
*Director of the United States Patent and Trademark Office*